US011441313B2

(12) United States Patent
McKenzie et al.

(10) Patent No.: US 11,441,313 B2
(45) Date of Patent: Sep. 13, 2022

(54) ENCLOSURE ASSEMBLY APPARATUS AND METHOD FOR FORMING SAME

(71) Applicant: Knoll, Inc., East Greenville, PA (US)

(72) Inventors: James Harrison McKenzie, East Greenville, PA (US); James Eldon, Pennsburg, PA (US); David McClanahan, Pennsburg, PA (US)

(73) Assignee: Knoll, Inc., East Greenville, PA (US)

( * ) Notice: Subject to any disclaimer, the term of this patent is extended or adjusted under 35 U.S.C. 154(b) by 183 days.

(21) Appl. No.: 16/887,582

(22) Filed: May 29, 2020

(65) Prior Publication Data

US 2020/0385985 A1 Dec. 10, 2020

Related U.S. Application Data

(60) Provisional application No. 62/858,379, filed on Jun. 7, 2019.

(51) Int. Cl.
*E04B 2/74* (2006.01)

(52) U.S. Cl.
CPC .... *E04B 2/7427* (2013.01); *E04B 2002/7474* (2013.01); *E04B 2002/7477* (2013.01)

(58) Field of Classification Search
CPC ..... E04B 2/7427; E04B 2002/7474; E04B 2002/7477
USPC ..... 52/238.1, 239
See application file for complete search history.

(56) References Cited

U.S. PATENT DOCUMENTS 2,821,450 A 1/1958 Knoll
2,881,876 A 4/1959 Williams
3,087,586 A * 4/1963 Gray ..... E04B 1/6141 52/241
3,628,299 A * 12/1971 Nakazawa ..... E04B 2/764 52/506.06
3,733,755 A * 5/1973 Butler ..... E04B 2/7854 52/36.6
4,086,734 A * 5/1978 Hayashi ..... E04B 2/82 52/126.4
4,248,325 A 2/1981 Georgopoulos
4,277,920 A * 7/1981 Dixon ..... E04B 2/827 52/64
4,287,698 A * 9/1981 Baus ..... E06B 1/64 52/241
4,377,195 A 3/1983 Weil
4,449,337 A * 5/1984 Gzym ..... E04B 2/825 52/126.4
4,535,577 A 8/1985 Tenser et al.
4,555,880 A 12/1985 Gzym et al.
4,596,098 A * 6/1986 Finkbeiner ..... E04B 2/7427 439/142

(Continued)

*Primary Examiner* — James M Ference
(74) *Attorney, Agent, or Firm* — Buchanan Ingersoll & Rooney PC

(57) ABSTRACT

An enclosure assembly apparatus can include a plurality of elements that can be arranged to facilitate positioning of an enclosure in a work space such as a room or floor of an office building or other building. Embodiments can be configured to facilitate relatively quick and level positioning of such an enclosure. Embodiments of the enclosure assembled via use of at least one embodiment of the enclosure assembly apparatus can be define a room, a meeting space, a privacy booth, a meeting cubicle, or other type of enclosure or work space within the room or floor of a building.

19 Claims, 11 Drawing Sheets

(56) References Cited

U.S. PATENT DOCUMENTS 4,667,450 A * 5/1987 Stefnik ..... E04B 2/7409 52/238.1
4,761,922 A * 8/1988 Black ..... E04B 2/74 160/135
4,881,353 A 11/1989 Braendel et al.
4,884,376 A * 12/1989 DeBlock ..... E04B 1/0046 52/92.2
4,905,428 A 3/1990 Sykes
4,949,518 A 8/1990 Nagel et al.
4,993,205 A 2/1991 Dull et al.
4,996,811 A 3/1991 Dull et al.
5,003,740 A 4/1991 Dull et al.
5,005,325 A 4/1991 Dull et al.
5,010,702 A * 4/1991 Daw ..... E04B 2/7409 52/241
5,038,539 A 8/1991 Kelley et al.
5,062,246 A * 11/1991 Sykes ..... E04B 2/7424 52/126.4
5,140,792 A * 8/1992 Daw ..... E04B 2/7409 52/238.1
5,155,955 A 10/1992 Ball et al.
5,159,793 A 11/1992 Deugo et al.
5,282,341 A 2/1994 Baloga et al.
5,287,909 A 2/1994 King et al.
5,309,686 A 5/1994 Underwood et al.
5,675,946 A 10/1997 Verbeek et al.
5,680,893 A 10/1997 Neer
5,740,650 A * 4/1998 Seiber ..... A47B 57/425 403/297
5,802,789 A * 9/1998 Goodman ..... A47B 83/001 52/238.1
5,809,708 A 9/1998 Greer et al.
5,836,121 A * 11/1998 Hofman ..... E04B 2/7425 52/241
5,899,036 A * 5/1999 Seiber ..... E04B 2/7424 52/241
5,930,963 A 8/1999 Nichols
5,950,386 A * 9/1999 Shipman ..... E04F 11/00 52/481.2
5,966,879 A 10/1999 Verbeek et al.
6,000,179 A * 12/1999 Musculus ..... E04B 2/7425 403/231
6,000,180 A 12/1999 Goodman et al.
6,002,613 A 12/1999 Cloud et al.
6,052,958 A 4/2000 Miedema et al.
D427,783 S 7/2000 Luedke
6,094,872 A * 8/2000 Ward ..... E04B 2/82 52/126.4
6,112,472 A * 9/2000 Van Dyk ..... A47B 83/001 52/220.7
6,131,347 A 10/2000 Hornberger et al.
6,152,048 A 11/2000 Vander Park
6,223,485 B1 5/2001 Beck et al.
6,266,935 B1 * 7/2001 Seiber ..... A47B 57/425 52/126.4
6,276,102 B1 8/2001 Shipman et al.
6,339,907 B1 1/2002 Dame et al.
6,349,516 B1 2/2002 Powell et al.
6,367,213 B1 4/2002 Reuter et al.
6,378,255 B1 4/2002 Eich et al.
D457,359 S 5/2002 Chan
6,389,773 B1 5/2002 Reuter et al.
D458,040 S 6/2002 Stannis et al.
6,446,396 B1 9/2002 Marangoni et al.
6,688,056 B2 * 2/2004 Von Hoyningen Huene ..... E04B 2/745 52/238.1
6,726,034 B2 4/2004 Holbrook et al.
6,772,567 B2 8/2004 Diffrient, Jr. et al.
6,883,277 B2 * 4/2005 Wiechecki ..... E04B 2/7427 52/238.1
6,896,028 B2 5/2005 Brennan
7,310,918 B1 12/2007 Reuter et al.
7,789,025 B2 9/2010 Michaud, II et al.
7,814,711 B2 * 10/2010 Milligan ..... E06B 3/5481 52/126.4
7,908,805 B2 3/2011 Metcalf et al.
D653,862 S 2/2012 Hairston
8,272,180 B2 * 9/2012 Glick ..... E04B 2/7425 52/239
8,365,798 B2 2/2013 Feldpausch et al.
8,967,054 B2 3/2015 Henriott et al.
9,617,732 B2 * 4/2017 Kopish ..... E04B 2/7457
D796,216 S 9/2017 Rockwell et al.
D800,459 S 10/2017 Rockwell et al.
9,920,520 B2 3/2018 Udagawa et al.
2002/0157335 A1 * 10/2002 Vos ..... E04B 2/821 52/238.1
2003/0089057 A1 * 5/2003 Wiechecki ..... E04B 2/745 52/238.1
2003/0213193 A1 * 11/2003 Carroll ..... E04B 2/7425 52/238.1
2004/0018740 A1 1/2004 Brown et al.
2005/0011138 A1 1/2005 Ball et al.
2008/0295426 A1 * 12/2008 Milligan ..... E06B 3/5481 52/238.1
2010/0242378 A1 * 9/2010 Cifelli ..... E04B 2/821 52/126.1
2012/0304441 A1 12/2012 Henriott
2012/0317899 A1 * 12/2012 Von Hoyningen Huene ..... E04B 2/7453 52/167.1
2014/0075861 A1 * 3/2014 Knauf ..... E04B 2/721 52/204.2
2016/0273214 A1 * 9/2016 Kopish ..... H02G 3/288
2017/0226749 A1 8/2017 Fjetland
2017/0284090 A1 * 10/2017 LeBlang ..... E04C 3/07
2018/0245334 A1 8/2018 Udagawa et al.
2018/0328031 A1 * 11/2018 Kopish ..... E04B 2/74
2020/0385985 A1 * 12/2020 McKenzie ..... E04B 2/7427

* cited by examiner

ENCLOSURE ASSEMBLY APPARATUS AND METHOD FOR FORMING SAME

CROSS-REFERENCE TO RELATED APPLICATIONS

The present application claims priority to U.S. Provisional Patent Application No. 62/858,379, which was filed on Jun. 7, 2019. The entirety of this provisional patent application is incorporated by reference herein.

FIELD

The present innovation relates to assemblies that can be utilized to define a work space in within a building (e.g. a room of a building) and methods and mechanisms used to make and use the same.

BACKGROUND

Work areas can often be defined within a room or floor of an office building or other structure. In many different types of situations, a particular area of such a room or office floor may have different work spaces defined. Cubicles, for example, can be utilized to form such work spaces for different personnel. In some instances, a room or enclosure may be desired to be formed in the room or office floor.

For instance, some types of enclosures can be defined by use of tables or desks and privacy screens. Examples of privacy screens can be appreciated from U.S. Pat. Nos. 9,920,520, 8,365,798, 7,789,025, 7,310,918, 6,896,028, 6,367,213, 6,002,613, 6,000,180, 5,966,879, 5,675,946, 5,680,893, 5,287,909, 4,325,597, 4,248,325, and 2,821,450, U.S. Design Pat. Nos. D800,459, D796,216, D653,862, D458,040, D457,359, and D427,783 and U.S. Patent Application Publication Nos. 2017/0226749 and 2012/0304441.

As another example, enclosures can be defined in a room or office floor by use of a cubicle type system, partition type system, or other type of enclosure forming assembly. Examples of such mechanisms can be appreciated from U.S. Patent Application Publication No. 2018/0245334, 2005/0011138, and 2004/0018740, and U.S. Pat. Nos. 2,881,876, 4,377,195, 4,535,577, 4,555,880, 4,881,353, 4,905,428, 4,949,518, 4,993,205, 4,996,811, 5,003,740, 5,005,325, 5,038,539, 5,155,955, 5,159,793, 5,282,341, 5,309,686, 5,809,708, 5,930,963, 6,052,958, 6,131,347, 6,152,048, 6,223,485, 6,276,102, 6,339,907, 6,349,516, 6,378,255, 6,389,773, 6,446,396, 6,726,034, 6,772,567, 7,908,805, and 8,967,054.

SUMMARY

An enclosure assembly apparatus and methods of the making and using the same are provided herein. Embodiments can be configured to facilitate a relatively quick assembly that can allow for adjustments to account for uneven, non-level flooring. Some embodiments can also be configured to facilitate securing portions of an enclosure apparatus to a floor in a relatively quick assembly process.

We have determined that some enclosure assembly systems can be time consuming to utilize to form an enclosure. Further, such systems can be relatively difficult to assemble due to a number of assembly related complications associated with such system designs. Embodiments of our enclosure assembly apparatus and methods of making and using the same can help address such problems.

In some embodiments, an enclosure assembly apparatus can include a rail for attachment to a floor and a rail connector that includes a first part and a second part where the first part is separable from the second part. The rail can have a channel for facilitating attachment of the rail connector to the rail. The channel can be sized and configured so that the first part and the second part are positionable in the channel when separated such that the first part is positionable adjacent to the second part in the channel to form an assembled body of the rail connector.

In some embodiments, the first part can have at least one foot and the second part can have at least one foot. The rail can have sidewalls that extend from opposite sides of a bottom of the rail to define the channel. Each sidewall can define a side slot that is in communication with the channel. Each side slot sized to receive a foot of the first part or a foot of the second part.

The first part and the second part can define a top hole when the assembled body of the rail connector is formed. A base element fastener can be extendable through the top hole.

Embodiments of the enclosure assembly apparatus can also include other components. For instance, there can be a column mounting device and a column connector. The column connector can have a first end for being received within the channel and a second end for being received within an opening of the column mounting device to attach the column mounting device to the rail. The column connector can include a plurality of interlockable parts to adjustably define a height of the column connector. Each interlockable part can be positionable to lock the part to another part to directly attach immediately adjacent parts.

In some embodiments, an enclosure assembly apparatus can include a rail for attachment to a floor and a rail connector. The rail connector can include a first part having a first foot and a second part having a second foot. The rail can have a channel for facilitating attachment of the rail connector to the rail. The channel can be sized and configured so that the first part and the second part are positionable in the channel when separated such that the first part is positionable adjacent to the second part in the channel to form an assembled body of the rail connector. The rail can have first and second sidewalls that extend from opposite sides of a bottom of the rail to define the channel, the first sidewall and the second sidewall can each define a side slot that is in communication with the channel. The side slot of the first sidewall can be sized to receive the first foot of the first part and the side slot of the second sidewall can be sized and configured to receive the foot of the second part. The first part and the second part can define a top hole when the assembled body of the rail connector is formed. A base element fastener can be extendable vertically through the top hole. A rail connector fastener can extending horizontally between the first part and the second part for maintaining the assembly body of the rail connector in an assembled state.

Embodiments of the apparatus can also include a panel having a hole. The base element fastener can extend into the hole for attachment of the panel to the rail. Embodiments can utilize multiple rail connectors for attachment to one or more panels or other base elements via the base element fasteners extending from the rail connectors.

Embodiments of the apparatus can also include column mounting devices. For instance, there can be a first column mounting device positionable adjacent a first end of the rail. A first column connector can have a first end for being received within the channel adjacent the first end of the rail. The first column connector can have a second end for being received within the opening of the first column mounting device to attach the first column mounting device to the rail. There can also be a second column mounting device positionable adjacent a second end of the rail. A second column connector can have a first end for being received within the channel adjacent the second end of the rail and also have a second end for being received within the opening of the second column mounting device to attach the second column mounting device to the rail.

In other embodiments, the enclosure assembly apparatus can include a base element connector positioned adjacent a second end of the rail. The base element connector can have a projection that extends vertically from a body for positioning within a base element for attachment of the base element to the rail. The base element connector can also have a rail end connector positionable within the channel adjacent the second end of the rail for attachment of the base element connector to the rail.

A method for assembling an enclosure is also provided. Embodiments of the method can include utilization of at least one embodiment of an enclosure assembly apparatus. In some embodiments, the method can include positioning a rail on a floor, fastening the rail to the floor, positioning a first part of a rail connector in a channel of the rail so that a foot of the first part extends into a first side slot defined by a first sidewall of the rail, positioning a second part of the rail connector in a channel of the rail so that a foot of the second part extends into a second side slot defined by a second sidewall of the rail that is opposite the first sidewall of the rail, and positioning a base element fastener adjacent to the first part and/or the second part during the positioning of the first part and the positioning of the second part so that when the first part and the second part are positioned in the channel the rail connector is placed into an assembled state that has a top hole through which the base element fastener extends.

Embodiments of the method can also include other steps. For instance, embodiments of the method can include attaching a column mounting device to a first end of the rail, and adjusting a height of the column mounting device. The column mounting device can be comprised of a plurality of interlockable parts. Each interlockable part can be positionable to lock the part to another part to directly attach immediately adjacent parts.

The method can also include positioning the column connector to attach the column connector to the rail. The column connector can have a bottom part that has an opening to receive an end of a column connector that extends from a first end of the rail.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of our enclosure assembly apparatus are shown in the accompanying drawings and certain exemplary methods of making and practicing the same are also illustrated therein. It should be appreciated that like reference numbers used in the drawings may identify like components.

FIG. 10 illustrates the rail connector 31 in an assembled position.

FIG. 12 illustrates the rail connector 31 in an assembled position for receipt of fasteners within holes of the rail connector 31.

DETAILED DESCRIPTION OF EXEMPLARY EMBODIMENTS

Figure 1:
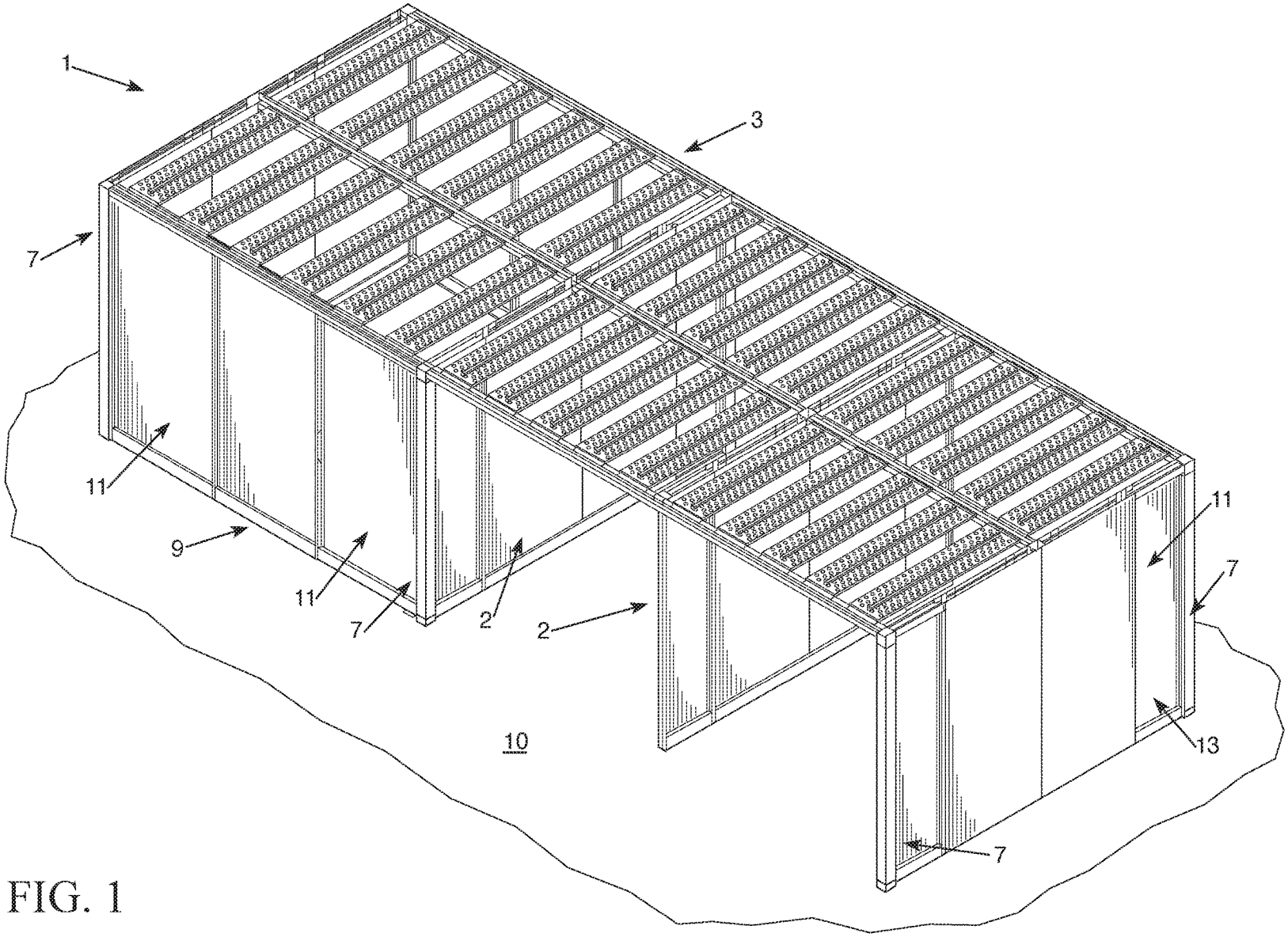
FIG. 1 is perspective view of a first exemplary embodiment of an enclosure assembly apparatus positioned to define multiple work space enclosures in a room of a building.
Figure 2:
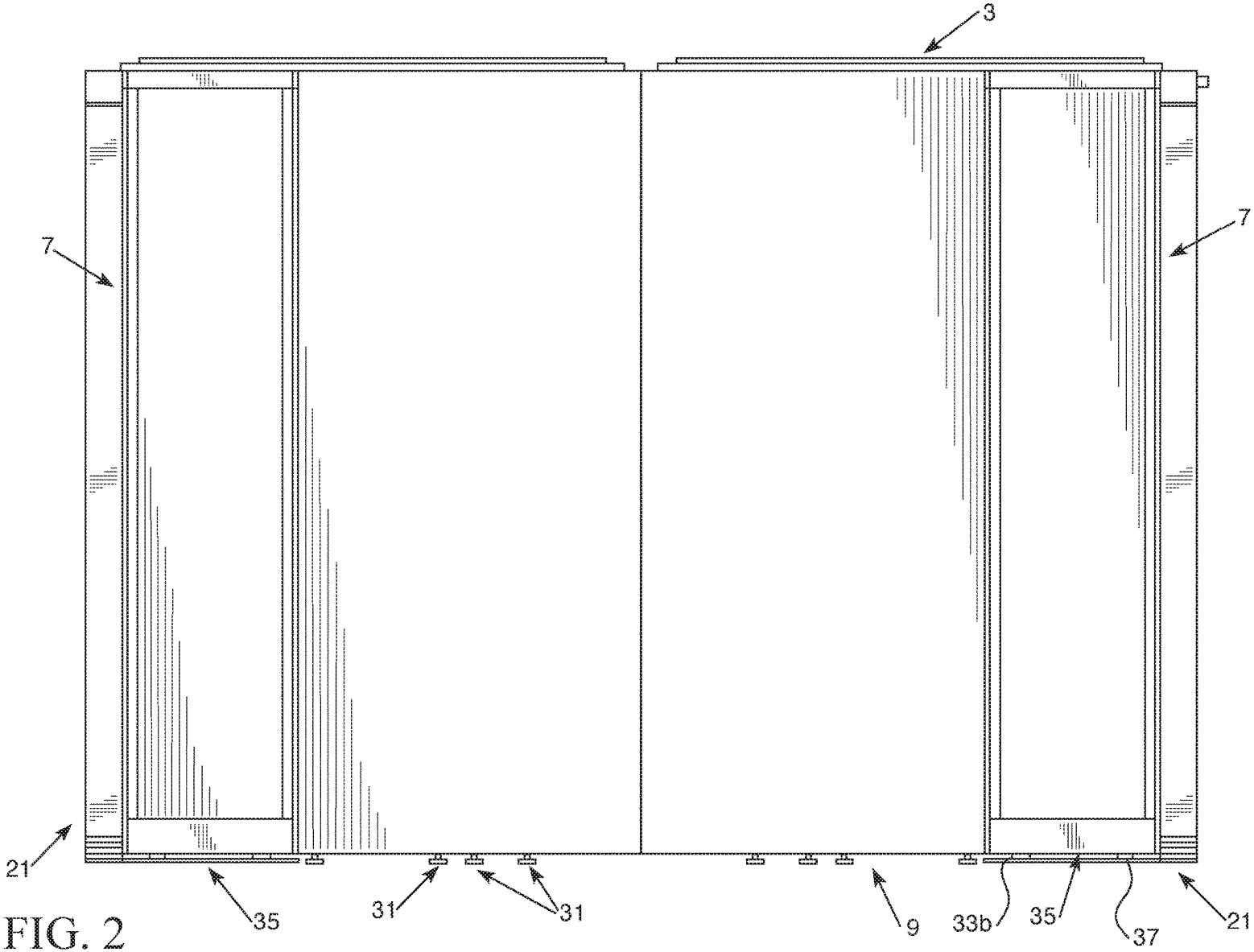
FIG. 2 is a side view of the first exemplary embodiment of the enclosure assembly apparatus shown in FIG. 1 with rail 9*a* removed to better illustrate components of the base 9.
Figure 3:
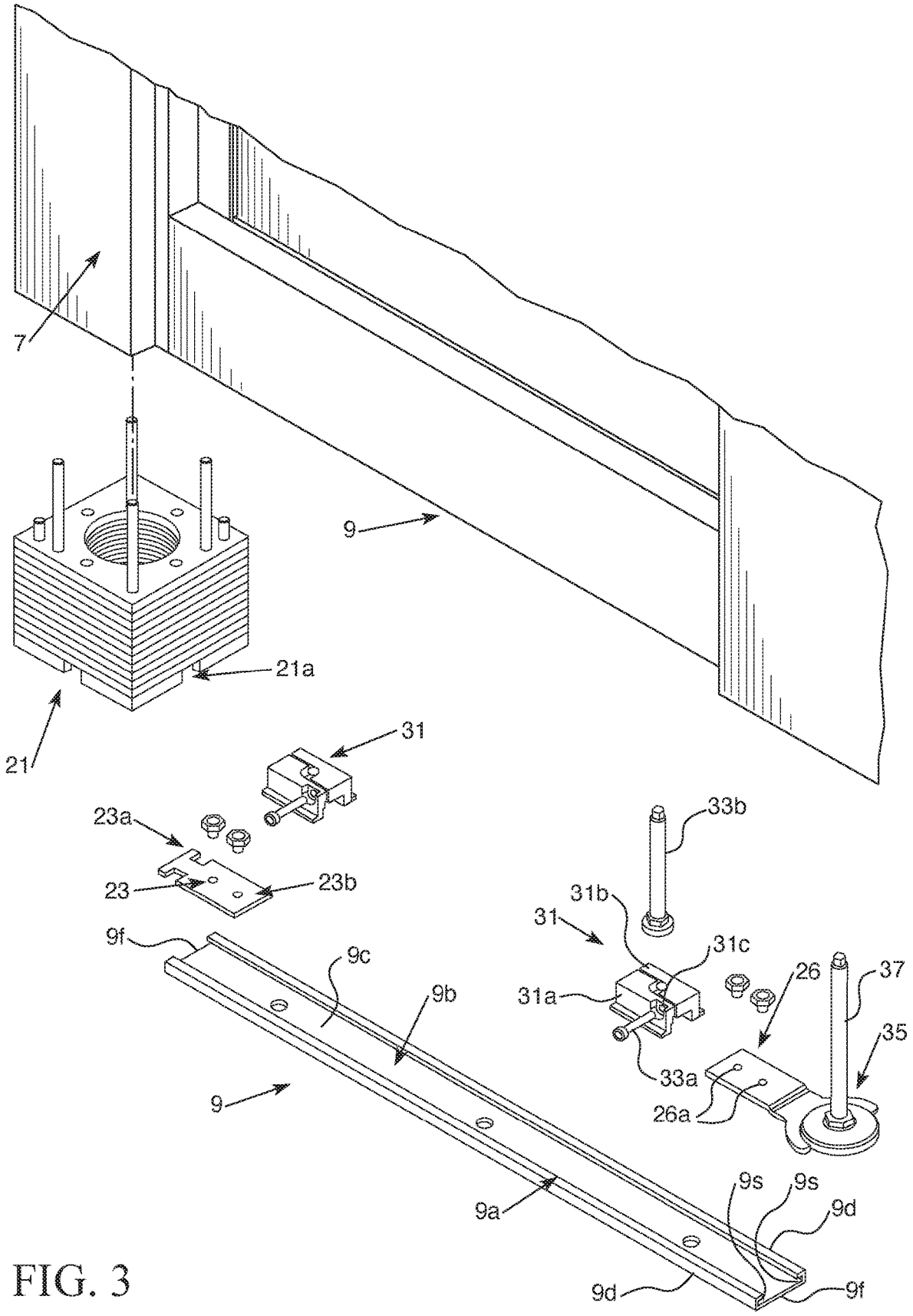
FIG. 3 is a partial exploded view of the first exemplary embodiment of the enclosure assembly apparatus shown in FIG. 1 that illustrates exemplary a column mounting device 21, base element connector 35, and rail connector 31 components of the base 9.
Figure 4:
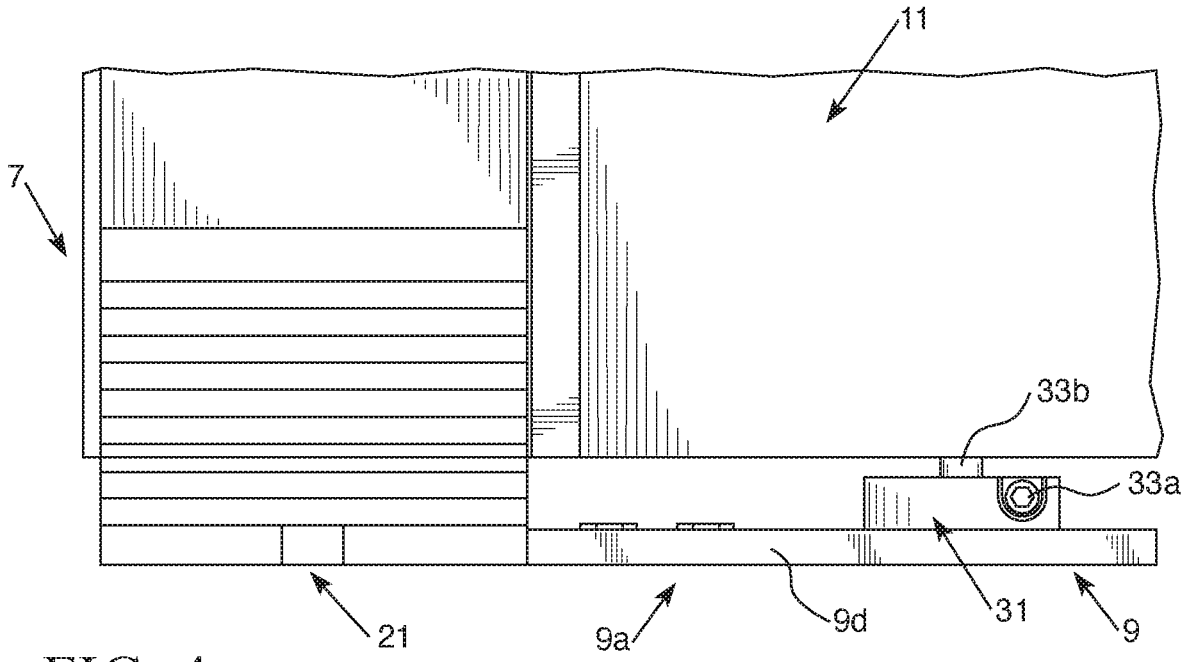
FIG. 4 is a first fragmentary lower side view of a first portion of the first exemplary embodiment of the enclosure assembly apparatus shown in FIG. 1.
Figure 5:
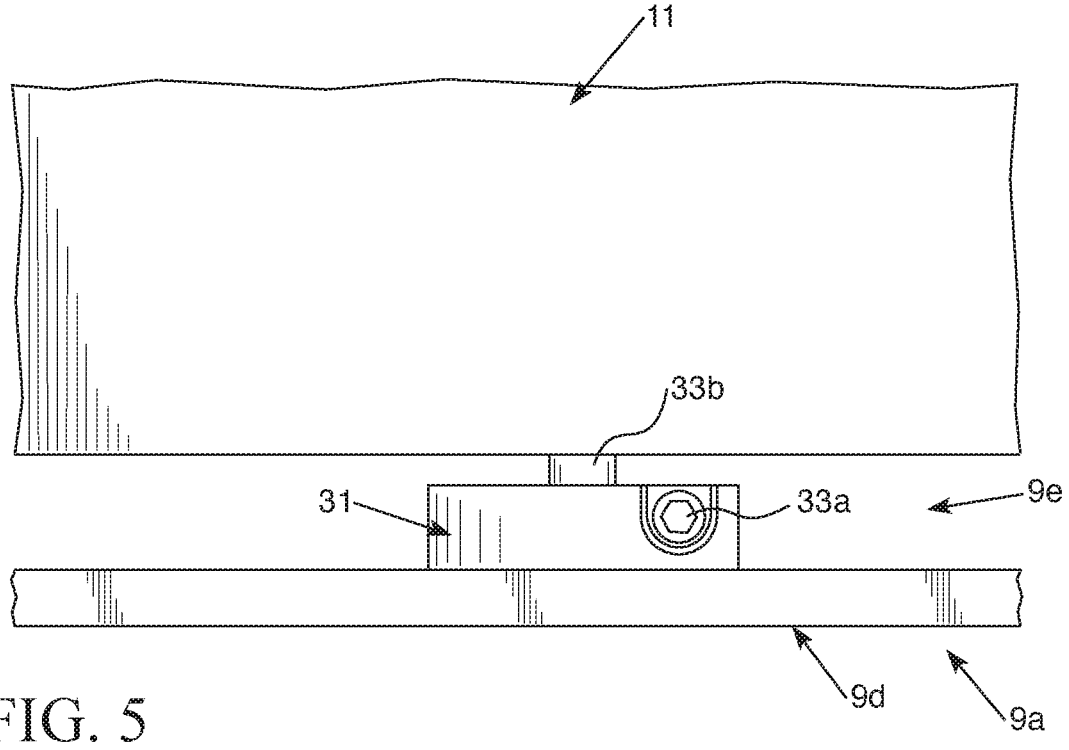
FIG. 5 is a fragmentary lower side view of a second portion of the first exemplary embodiment of the enclosure assembly apparatus shown in FIG. 1.
Figure 6:
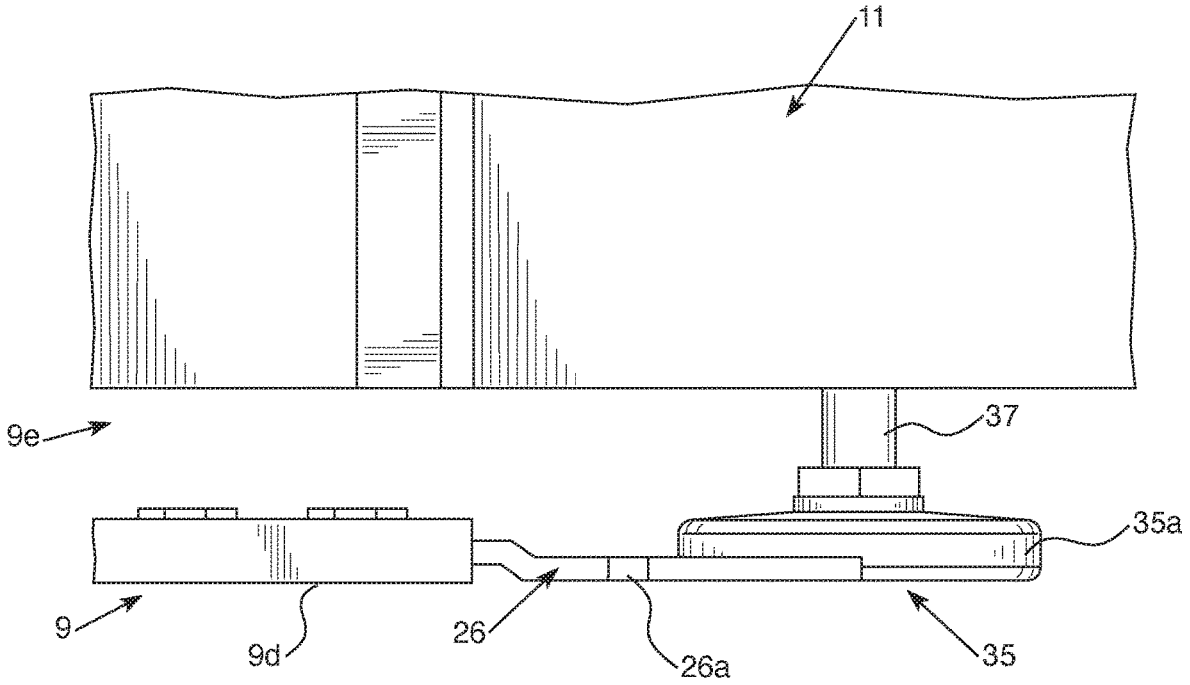
FIG. 6 is a fragmentary lower side view of a third portion of the first exemplary embodiment of the enclosure assembly apparatus shown in FIG. 1.

Referring to FIGS. 1-14, an enclosure assembly apparatus 1 can be positioned to define multiple work space enclosures in a room of a building. The formed enclosure can include a ceiling 3. The ceiling can at least partially cover the top of the formed enclosure. The formed enclosure can define a single work space therein or multiple work spaces separated by one or more internal walls 2. Openings can be defined between walls to permit personnel to move into and out of work spaces defined in the enclosure. Doors can be connected to permit such openings to be opened or closed. For instance, a moveable curtain can be mounted to a fame element of the enclosure to function as a door or a door having hinges can be mounted to a column 7 or between upper and lower frame elements for providing such a door. Alternatively, the openings can be kept in an always open state.

The enclosure assembly can include a number of columns 7. The columns can be vertically elongated members. In some embodiments, the columns 7 can be structured as beams, rods, or supports that extend vertically from adjacent a floor to an upper frame element. The upper frame element can be a beam, rod or other type of horizontally extending member. Ceiling elements can be attached between upper frame elements to define the ceiling 3. In other embodiments, the enclosures defined by the enclosure assembly apparatus 1 may not have a ceiling 3. Instead, the top of the formed work area defined enclosure can be open so personnel can look through the top to see other parts of the room (e.g. ceiling of the room of the building, etc.).

Panels 11 can be positioned to define walls of the enclosure. One or more panels 11 can be positioned between spaced apparat columns 7, for example, to define walls of an enclosure that is configured to define at least one work space enclosure. Each panel can have a rectangular shape (e.g. be a rectangular panel or plate etc.). Each panel 11 can alternatively have a different type of shape (e.g triangular, hexagonal, irregular shape, etc.).

The enclosure formed by the enclosure assembly apparatus 1 can include a base 9. The base 9 can be utilized to facilitate attachment of the panels 11 and/or columns 7 to a floor 10 of the room of a building in which the work space enclosure(s) are to be defined. Such attachment can help improve the safety of the work space enclosure(s) by providing a secure positioning of the enclosure assembly in an assembled state in the room of the building.

The enclosure assembly can also be configured to include moveable panels 13. Each moveable panel 13 can be configured to move relative to an upper frame element and/or a lower frame element of the base 9. For example, moveable panels 13 can slide along upper and/or lower frame elements for moving to different positions along a defined path. Such moveable panels can provide a tackable surface that is moveable, for example. It is also contemplated that the moveable panels 13 can alternatively be configured to function as a door in some embodiments.

We have determined that floors are not always level and that this deficiency can affect the structure and assembly of an enclosure. For instance, when a floor is not level, it can require a significant amount of assembly steps to address such an issue when assembling an enclosure. To avoid such significant amounts of time and effort, we have determine that a floor attachment system can be utilized to help provide for level positioning of at least some elements of the enclosure assembly apparatus 1.

Additionally, it can take a significant amount of time to mount parts of the base 9 to a floor 10. We have determined that a base attachment system can be utilized to facilitate a quicker and easier assembly to account for such an issue.

The base 9 of the enclosure assembly apparatus 1 can include a rail 9*a* that has sidewalls 9*d* that extend above a bottom 9*c* and extend between opposite first and second ends 9*f*. The body of the rail can include pre-drilled holes in the bottom 9*c* to facilitate positioning of fasteners for attachment of the rail 9*a* to the floor 10. The rail can be structured to define a channel 9*b* between the spaced apart sidewalls 9*d* and bottom 9*c*. The channel 9*b* can be in communication with side slots 9*s* that can be defined at the opposite sides of the rail via the sidewalls 9*d*. For example, each side slot 9*s* can be defined by a top of a respective sidewall 9*d* that extends inwardly over the bottom 9*c* of the rail 9*a* to define a side slot 9*s* having a side mouth defining the interface between the channel 9*b* and the side slot 9*s*. Each side slot 9*s* can be configured to help retain a foot or other type of projection to prevent a structure being positioned into the rail 9 via channel 9*b* from being easily dislodged out of the rail 9 during assembly.

A first end 9*f* of the rail can be configured to receive a first end 23*b* of a column connector 23. The first end 23*b* of the column connector can include opposite side portions that extend into the side slots 9*s* for attachment to the rail 9*a* via the channel 9*b*. The column connector 23 can be configured to attach a column mounting device 21 to the first end 9*f* of the rail 9*a*. For instance, the column connector 23 can have a second end 23*a* that is configured to be matingly received within an opening 21*a* of a column mounting device 21. The column mounting device 21 can be configured for attachment to a bottom of a column 7 to facilitate attachment of the bottom of the column 7 to the floor 10.

The second end 9*f* of the rail can be configured to receive a first end 23*b* of another column connector 23 for attachment with another column mounting device 21. The second end 9*f* of the rail 9*a* can also be configured to receive a rail end connector 26 for attachment to a base element connector 35. The rail end connector 26 can include at least one hole 26*a* through which a fastener can be passed for attachment of the rail end connector 26 to the rail 9*a* and/or the floor 10.

The rail end connector 26 can also be defined as a part of a base component of a base element attachment body 41 that can be connected to an end 9*f* of the rail 9*a*. The rail end connector 26 can include a body that is sized to slide along the bottom of the rail 9*a* in the channel 9*b* so that opposite sides of the body of the rail end connector 26 are positionable within the side slots 9*s* while a middle part of the body is within the channel 9*b*. Such a base element attachment body 41 can include a base 43 having a rail end connector 26 extending from at least one side of the base 43 for attachment to the rail 9*a*. The base element attachment body 41 can also include a projection 45 that extends upwardly for receipt into a hole of a base element for being matingly received therein to facilitate attachment of a base element to the rail 9*a* (e.g. via the mating interference fit between projection 45 and a corresponding hole in the base element and/or via use of one or more fastening mechanisms such as a screw, adhesive, etc.).

Embodiments of the base element connector 35 can include a base 35*a* and a projection 37 that extends vertically upwardly from the base 35*a* for insertion into and/or attachment to a panel 11 or other base element of the frame of the enclosure. For example, the base element connector 35 can be positioned so that the projection 37 is inserted into an intermediate base support element to help affix that element to the rail 9*a*. The projection 37 can be integral to a body of the base element connector 35 or can be a fastener (e.g. bolt, screw) that is insertable through the base element connector 35 for fastening with a base element.

The channel 9*b* of the rail 9*a* can be configured to receive at least one rail connector 31. Each rail connector 31 can include a first part 31*a* that is separable from a second part 31*b*. A rail connector fastener 33*a* can be passed through assembly holes 31*c* in the first and second parts 31*a* and 31*b* to form a body of the assembled rail connector 31. The rail connector fastener 33*a* can extend horizontally between the first part 31*a* and the second part 31*b* for maintaining the assembled body of the rail connector 31 in an assembled state. The formed, assembled body of the rail connector 31 can have a top hole 31*d* that is sized to permit a base element fastener 33*b* to be extend through top hole 31*d* for attachment to a panel 11 (e.g. a bottom of the panel 11) or a bottom panel element to which a panel 11 is attached. The first part 31*a* and the second part 31*b* of the rail connector 31 can each include a horizontally extending foot 31*e* that is sized to mate within a side slot 9*s* that is in communication with the channel 9*b* of the rail 9*a*.

Figure 13:
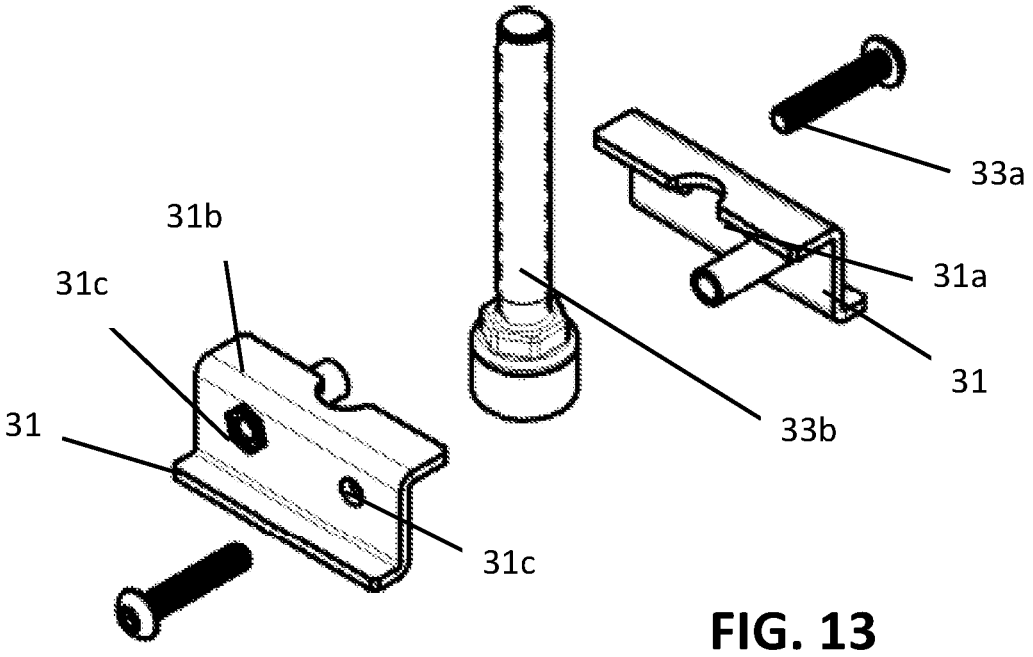
FIG. 13 is an exploded view of an exemplary embodiment of a rail connector 31.
Figure 14:
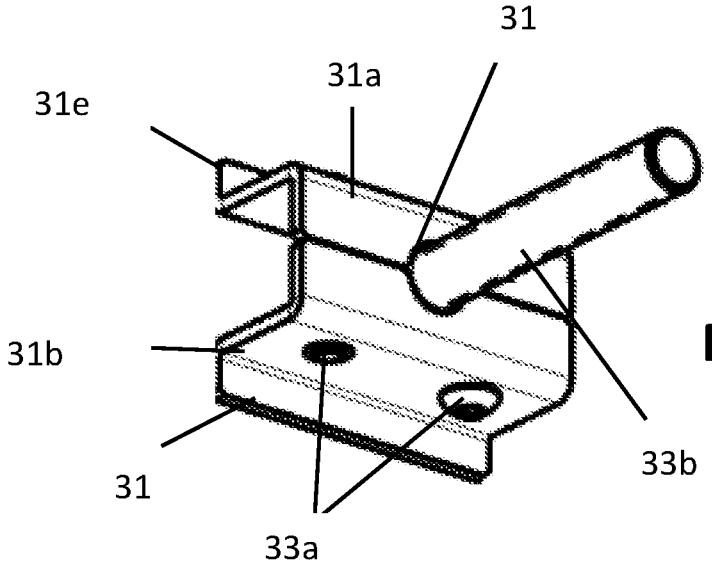
FIG. 14 is a perspective view of the exemplary embodiment of the rail connector 31 shown in FIG. 13.

As can be appreciated from FIGS. 13 and 14, embodiments of the rail connector 31 can be configured to utilize more than one rail connector fastener 33*a*. For instance, there may be a first rail connector fastener 33*a* that extends horizontally from the first part 31*a* to the second part 31*b* via first assembly holes 31*c* in these parts and also be a second rail connector fastener 33*a* that extends horizontally from the second part 31*b* to the first part 31*a* by passing through second assembly holes 31*c* in these part so that the base element fastener 33*b* is located at a position between the first and second rail connector fasteners 33*a* and extendable from top hole 31*d*.

The separable first and second parts 31*a* and 31*b* can be configured to permit the rail connectors to be positioned for attachment to the rail 9*a* after the rail is affixed to a floor 10 by use of a rail connector attachment process. Each rail connector 31 can be attached to the rail 9*a* at a desired location via the channel 9*b* and side slots 9*s* utilizing this same rail connector attachment process.

For instance, fasteners can be passed through the bottom 9*c* of the rail to attach the rail to a floor 10 (e.g. subflooring, or other floor structure of a room of a building). Thereafter, the first and second parts 31*a* and 31*b* of each rail connector 31 can be in a separate state so each individual part can be positioned in the channel 9*b* with foot 31*e* inserted into a respective side slot 31*s*. Each part can be positioned adjacent to each other while their foot 31*e* is in its respective side slot 9*s* to define an assembled body of the rail connector 31 in its assembled state. In this position, the assembly hole(s) 31*c* in a sidewall of the first part 31*a* can be aligned with the assembly hole(s) 31*c* of the second part 31*b*. The assembly holes 31*c* can be positioned so that they are positioned above the sidewalls 9*d* of the rail 9*a* when the feet 31*e* of the rail connector body are within the side slots 9*s* of the rail. This positioning of the assembly holes 31*c* can permit at least one rail connector fastener 33*a* to be easily passed through the aligned assembly holes 31*c* while the rail 9*a* is mounted to the floor 10 to place the rail connector 31 into its assembled state. This can facilitate attachment of the rail connector 31 to the rail 9*a* while also permitting rail connectors 31 to be easily positioned in spaced apart locations along a length of the rail 9*a* without having to slide each rail connector along the length of the rail in a series due to the separable parts that are alignable and integratable with each other via the rail connector fastener 33*a*. The ease with which the rail connectors 31 can be positioned along a length of a rail 9*a* can greatly improve the speed and efficiency of the formation of an enclosure.

Before the rail connector fastener (s) 33*a* is passed through the assembly holes 33*c*, a base element fastener 33*b* can be positioned in the top hole 31*d* of the rail connector 31. Such positioning of the base element fastener can allow the base element fastener 33*b* to be attached to the rail connector 31 when the rail connector 31 is adjusted into its assembled state. The base element fastener can be positioned adjacent an aperture of the first part 31*a* or the second part 31*b* during the positioning of these parts next to each other so that when the top hole 31*d* is formed when those parts are positioned to from the rail connector body 31 via their feet 31*e* being within side slots 31*e*, the base element fastener is located in the formed top hole 31*d*. After the first and second parts 31*a* and 31*b* are aligned to form the top hole 31*d* and the base element fastener 33*b* is positioned to extend from that top hole 31*d*, the rail connector fastener 33*a* can be passed through the aligned assembly holes 31*c* to place the rail connector in its assembles state.

After the rail connectors 31 are attached to the rail 9*a*, panels 11 can be attached to the rail via the base element fasteners 33*b* of the rail connectors 31. The base element fasteners 33*b* can be inserted into holes in the bottom of panels or the bottom of panel elements to which the panels 11 are attached. A wrench or other tool could be utilized to rotate the base element fasteners for facilitating attachment. In other embodiments, the linear sliding of the base element fasteners 33*b* into corresponding holes of base elements (e.g. panels 11, etc.) can be sufficient for the attachment.

The positioning of the base element fasteners 33*b* can permit each base element to which it is attached to be selectively positioned to account for a non-level floor 10 to which the rail 9*a* can be attached. For example, some panels 11 or bottom panel elements attached to the panels 11 can be at different locations on base element fasteners 33*b* (e.g. at different heights along the base element fasteners 33*b*) so that the panels 11 can be positioned in a level manner even though the floor 10 may not be level. A gap 9*e* defined between the bottom of the panels 11 or bottom panel elements to which the panels 11 may be attached and the rail 9*a* can then be covered by a covering or insert. Such a covering or insert may be, for example, a relatively thin foam material having a pre-selected color (e.g. a black color) or an elastomeric bulb seal element to fill the gap. As another example, the covering or insert can be structured as strips sized to fit within the defined gap for attachment to the rail and bottom of the panels 11 for covering the gap.

Columns 7 can be positioned at perimeter corners of an enclosure and attached to ends 9*f* of different rails 9*a* via column mounting devices 21. Each mounting device 21 can include an opening 21*a* on each of its sides to facilitate attachment to different rails 9*a*. Each mounting device 21 can be configured to include multiple different separable interlockable parts to provide a mounting device 21 that has an adjustable height. This adjustable height can account for floor leveling issues so that different mounting devices 21 have different heights for attachment of different columns to account for a non-level floor 10.

Figure 7:
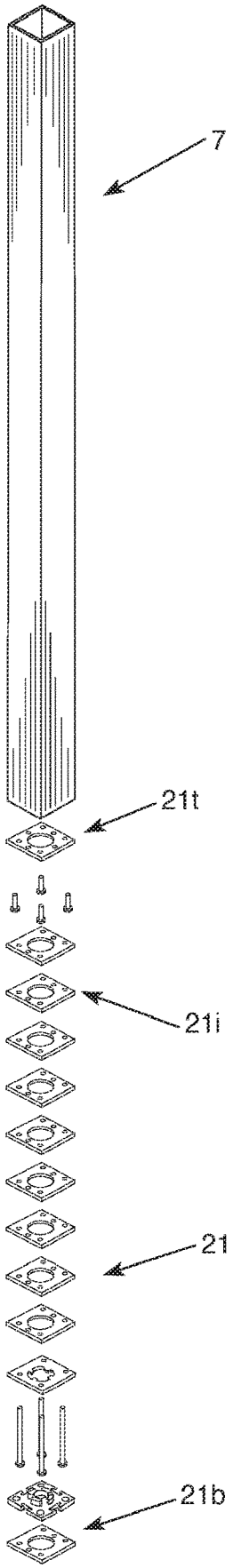
FIG. 7 is an exploded view of an exemplary column 7 of the first exemplary embodiment of the enclosure assembly apparatus shown in FIG. 1.
Figure 8:
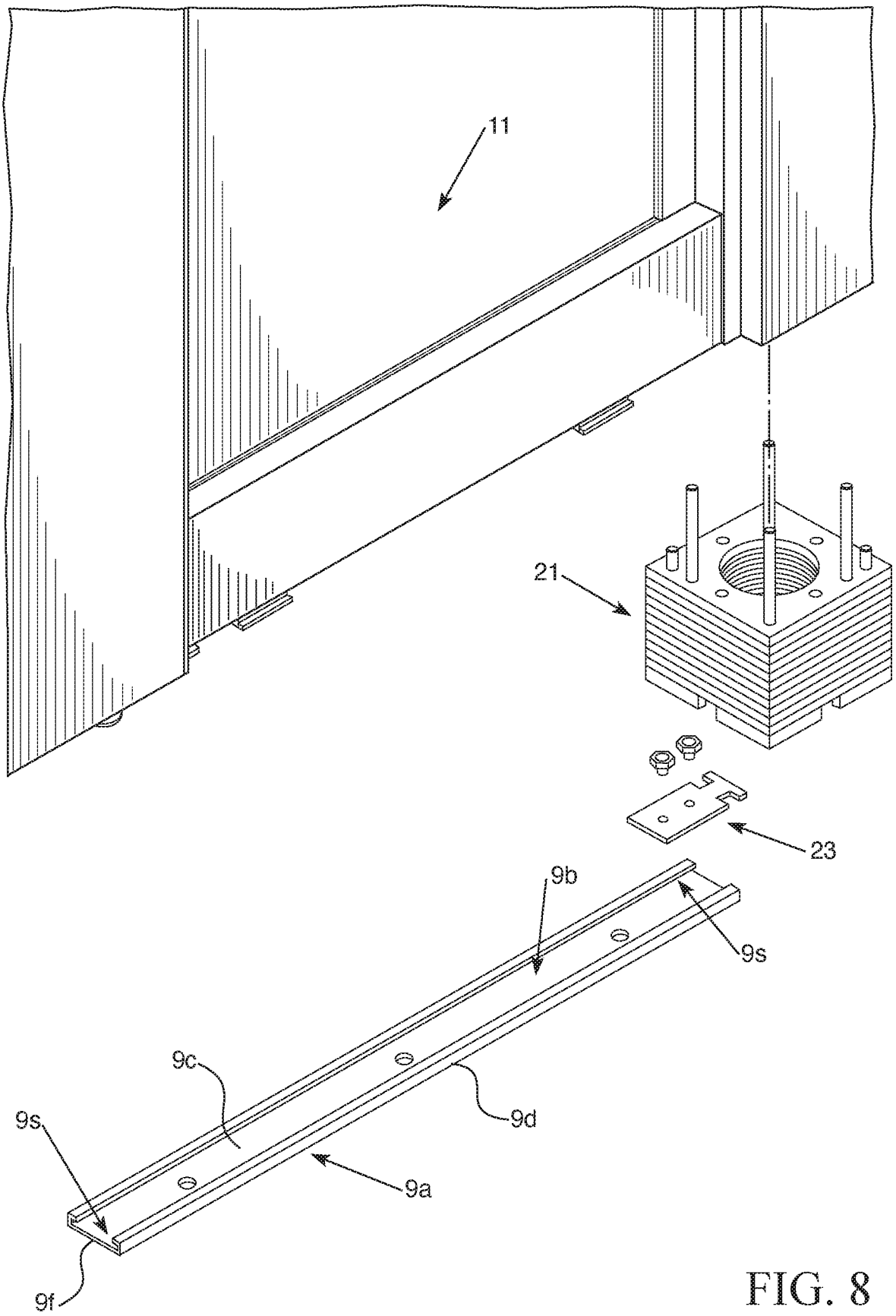
FIG. 8 is a fragmentary exploded view of the first exemplary embodiment of the enclosure assembly apparatus shown in FIG. 1.
Figure 9:
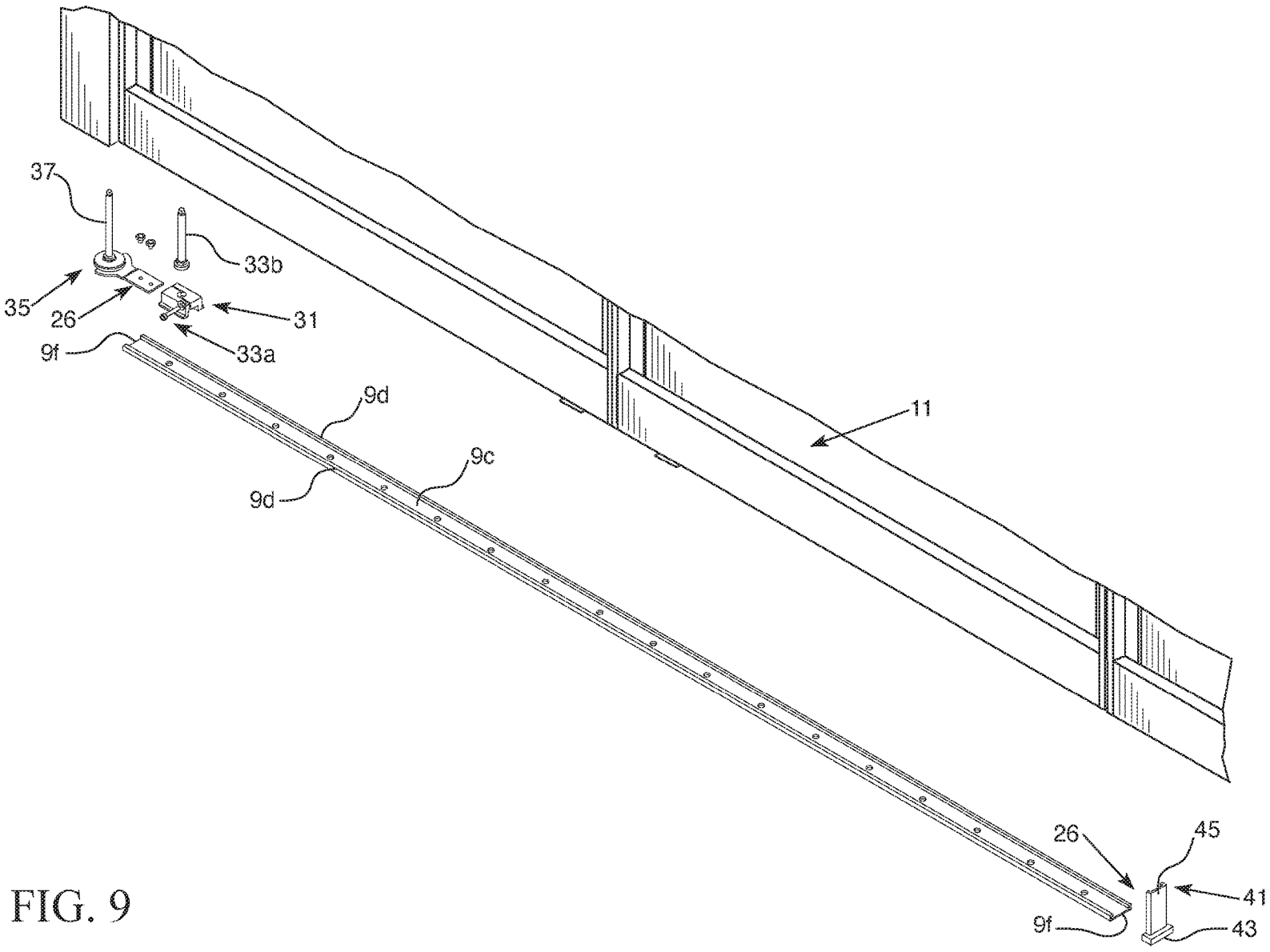
FIG. 9 is a fragmentary exploded view of the first exemplary embodiment of the enclosure assembly apparatus shown in FIG. 1.
Figure 10:
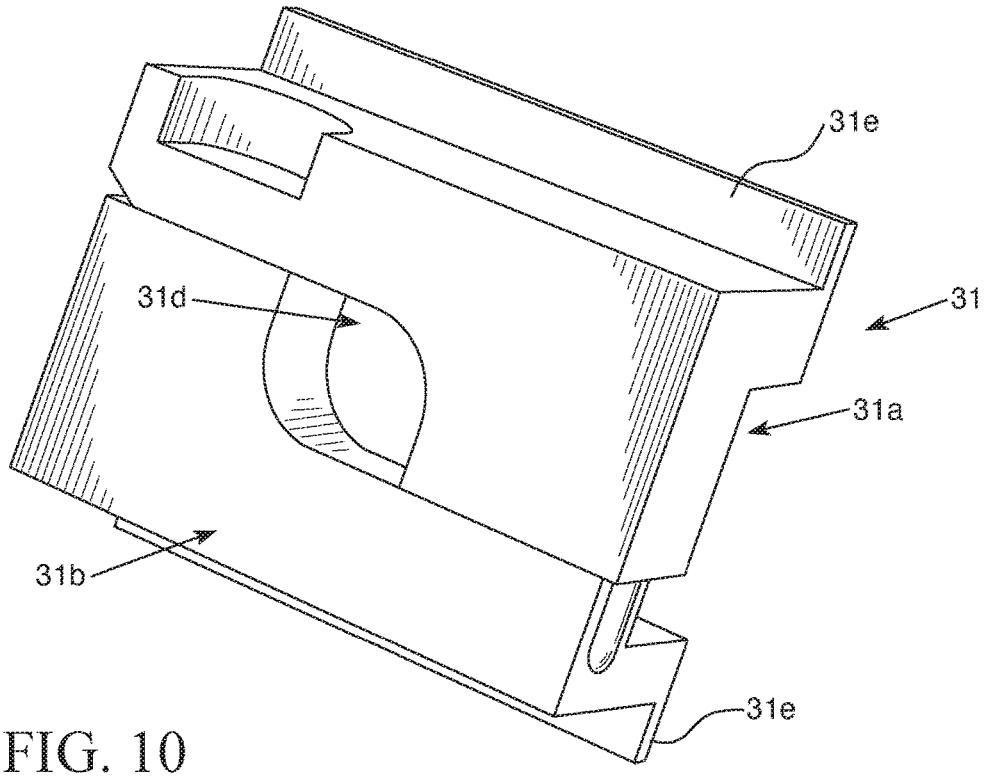
FIG. 10 is a perspective view of a first exemplary embodiment of a rail connector 31 of the first exemplary embodiment of the enclosure assembly apparatus shown in FIG. 1.
Figure 11:
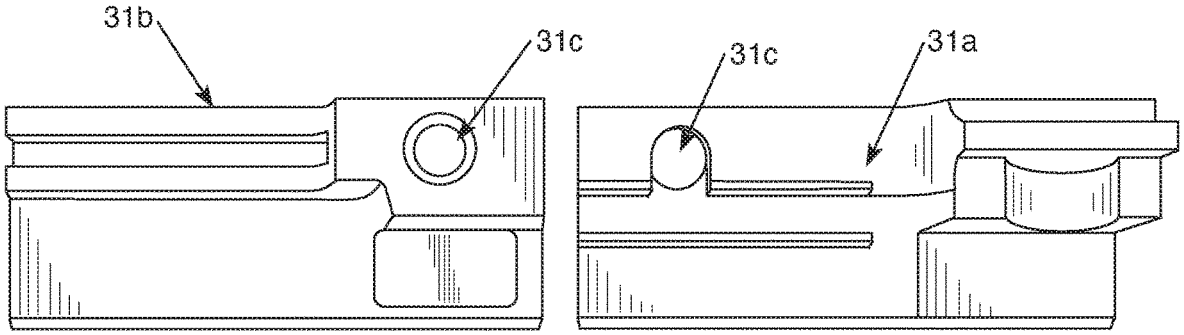
FIG. 11 is a perspective view of a first and second bodies of a first exemplary embodiment of a rail connector 31 of the first exemplary embodiment of the enclosure assembly apparatus shown in FIG. 1 shown in a separated state.
Figure 12:
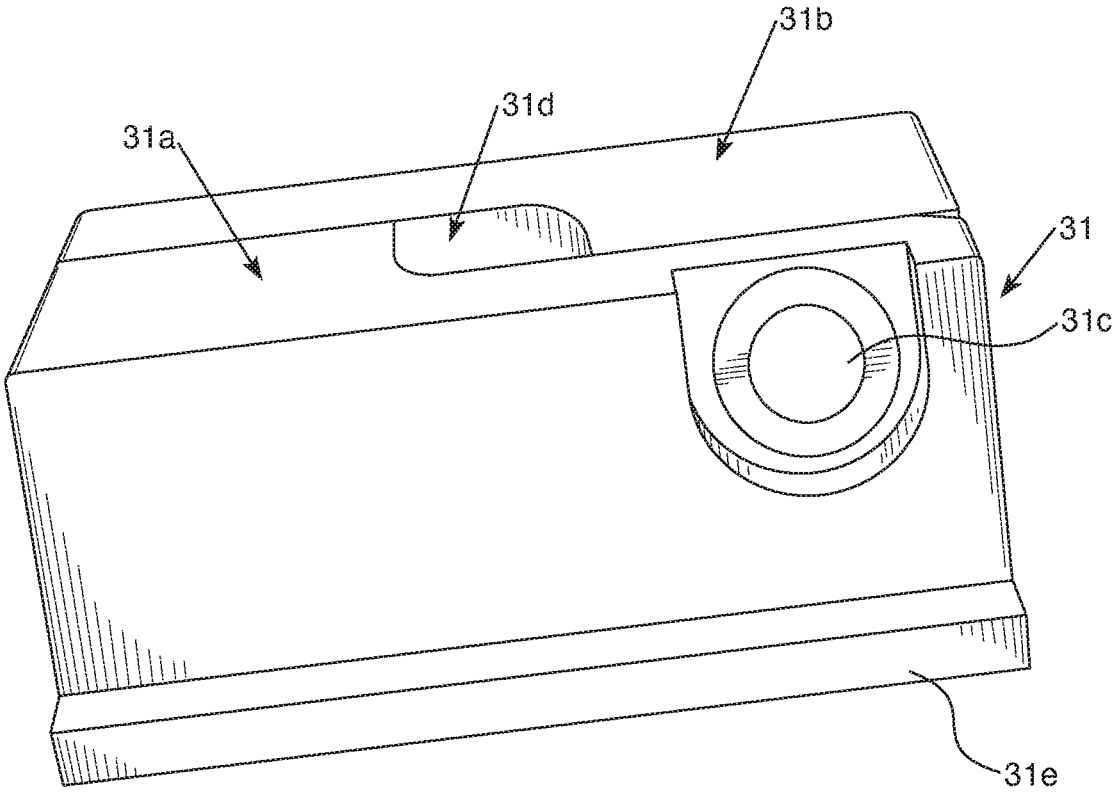
FIG. 12 is a perspective side view of a first exemplary embodiment of a rail connector 31 of the first exemplary embodiment of the enclosure assembly apparatus shown in FIG. 1.

For instance, as can be appreciated from FIG. 7, each column mounting device 21 can include a top part 21*t* a bottom part 21*b* and may also include one or more intermediate parts 21*i*. Each part can be releaseably attached directly to an immediately adjacent part via a mating profile. In some embodiments, each part can be positioned on top of an immediately adjacent part and subsequently moved to lock that part onto the lower part to form a direct connection of the immediately adjacent parts. The number of parts for any one column mounting device 21 can be adjusted to account for floor level issues. The height of each part can define the extent to which this type of adjustment can be provided. In some embodiments, the height of each part of the column mounting device 21 can be relatively small to allow for a significant degree of modification to account for floor level issues. Each part of the mounting device can have one or more holes that are alignable with the holes of other parts when the body of the mounting device 21 is assembled via interconnection of the multiple parts so that fasteners are passable through those holes for fastening to the bottom of a column 7. The fasteners in combination with the attachment of each mounting device to at least one rail 9*a* can facilitate a secure mounting of a column 7 to the floor 10.

Embodiments of the enclosure assembly apparatus 1 can facilitate a quicker and easier assembly of work space enclosures. For example, in some embodiments, rails 9*a* can be attached to a floor to define a pre-selected work space enclosure shape. The rail connectors 31 and column mounting devices 21 can then be attached to the rails 9*a*. Base element connectors 35 and/or 41 can also be attached to the rails 9*a*. Then, columns 7 and panels 11 can be attached to the rails 9*a* via these mounting devices and connectors while also taking into account issues that may arise due to a non-level floor 10. After the columns 7 and panels are attached, inserts or coverings can be positioned to cover any gap that may be present between the rails 9*a* and the bottom of panels 11 or bottom panel elements. The cover can include an elongated covering element that extends along a length of the rail to cover the gap and hide the gap from view. The covering element can be configured to be comprised of a foam-type material, or other type of resilient material that can be compressible for providing a resilient interference fit between the rail 2 and bottoms of panels 11 and/or other bottom elements within the gap to cover the gap, which may not have a uniform height. For example, the covering element can be configured as a rubber bulb seal or an elastomeric bulb seal in some embodiments. A ceiling 3 can also be formed after the columns and panels are positioned for enclosures in which a ceiling is desired.

It should be appreciated that some embodiments of the enclosure assembly apparatus can include a rail 9*a* for attachment to a floor and a plurality of rail connectors 31. Each of the rail connectors 31 can include a first part 31*a* having a first foot 31*e* and a second part 31*b* having a second foot 31*e*. The rail 9*a* can have a channel 9*b* for facilitating attachment of the rail connector 31 to the rail 9*a*. The channel 9*b* can be sized and configured so that the first part 31*a* and the second part 31*b* of each rail connector 31 are positionable in the channel 9*b* when separated such that the first part 31*a* is positionable adjacent to the second part 31*b* in the channel 9*b* to form an assembled body of the rail connector 31.

The rail 9*a* can have first and second sidewalls 9*d* that extend from opposite sides of a bottom of the rail 9*a* to define the channel 9*b*. The first sidewall 9*d* and the second sidewall 9*d* can each define a side slot 9*s* that is in communication with the channel 9*b*. The side slot 9*s* of the first sidewall can be sized to receive the first foot 31*e* of the first part 31*a* and the side slot 9*s* of the second sidewall 9*d* can be sized and configured to receive the foot 31*e* of the second part 31*b*. The first part 31*a* and the second part 31*b* can define a top hole when the assembled body of the rail connector 31 is formed. A base element fastener 33*b* can be extendable vertically through the top hole. A rail connector fastener 33*a* can extending horizontally between the first part 31*a* and the second part 31*b* for maintaining the assembly body of the rail connector in an assembled state.

The assembly can include multiple spaced apart rail connectors. The rail connectors 31 can be positioned so that the spaced apart base element fasteners 33*b* extend vertically for attachment to one or more base elements (e.g. panels, horizontally extending bottom rail of an enclosure to which panels are attachable, a bottom frame element, etc.).

There can be a first column mounting device 21 positionable adjacent a first end of the rail. A first column connector 23 can have a first end for being received within the channel adjacent the first end of the rail. The first column connector 23 can have a second end for being received within the opening of the first column mounting device 21 to attach the first column mounting device to the rail 9*a*. In some embodiments, there can also be a second column mounting device 21 positionable adjacent a second end of the rail 9*a*. A second column connector 23 can have a first end for being received within the channel adjacent the second end of the rail and also have a second end for being received within the opening of the second column mounting device 21 to attach the second column mounting device to the rail.

In other embodiments, the enclosure assembly apparatus can include a base element connector 35 positioned adjacent the second end of the rail 9*a*. The base element connector 35 can have a projection 37 that extends vertically from a body for positioning within a base element for attachment of the base element to the rail. The base element connector 35 can also have a rail end connector 26 positionable within the channel adjacent the second end of the rail for attachment of the base element connector to the rail.

A resilient covering member can also be provided to cover a gap that may have a variable height between the rail 9*a* and the bottom(s) of the one or more base elements attached to the rail. The resilient covering can be compressible to facilitate covering an entirety of the gap while also accommodating the non-uniform height of the gap.

It should be understood that other modifications to the enclosure assembly apparatus can be made to meet a particular set of design criteria. For example, it is contemplated that a particular feature described, either individually or as part of an embodiment, can be combined with other individually described features, or parts of other embodiments. The elements and acts of the various embodiments described herein can therefore be combined to provide further embodiments. As another example, the size, shape and weight of a partition body or frame element can be any size or shape to meet a particular set of design criteria. As yet another example, the type of mounting connector that is utilized in an embodiment of the enclosure assembly apparatus may utilize other types of connector structure geometry that may facilitate use of a pre-selected fastening mechanism (e.g. bolts, screws, etc.) to meet a particular set of design criteria.

Therefore, while certain exemplary embodiments of our enclosure assembly apparatus and methods of making and using the same have been discussed and illustrated herein, it is to be distinctly understood that the invention is not limited thereto but may be otherwise variously embodied and practiced within the scope of the following claims.

What is claimed is:

1. An enclosure assembly apparatus comprising:

a rail for attachment to a floor;

a rail connector comprising a first part and a second part, the first part being separable from the second part, the rail having a channel for facilitating attachment of the rail connector to the rail, the channel sized and configured so that the first part and the second part are positionable in the channel when separated such that the first part is positionable adjacent to the second part in the channel to form an assembled body of the rail connector; and wherein the first part has a foot, the second part has a foot, and the rail has sidewalls that extend from opposite sides of a bottom of the rail to define the channel, each sidewall defining a side slot that is in communication with the channel, each side slot sized to receive the foot of the first part or the foot of the second part.

2. The enclosure assembly apparatus of claim 1, wherein the first part and the second part define a top hole when the assembled body of the rail connector is formed, a base element fastener being extendable vertically through the top hole, a rail connector fastener extending horizontally between the first part and the second part for maintaining the assembly body of the rail connector in an assembled state.

3. The enclosure assembly apparatus of claim 1, comprising:

a column mounting device having an opening;

a column connector having a first end for being received within the channel and a second end for being received within the opening of the column mounting device to attach the column mounting device to the rail.

4. The enclosure assembly apparatus of claim 3, wherein the column connector is comprised of a plurality of interlockable parts to adjustably define a height of the column connector so the height of the column connector is adjustable.

5. The enclosure assembly apparatus of claim 4, wherein each of the interlockable parts is positionable to lock the interlockable part to another one of the interlockable parts immediately adjacent to the interlockable part for direct attachment.

6. A method for assembling an enclosure, comprising:

positioning a rail on a floor;

fastening the rail to the floor;

positioning a first part of a rail connector in a channel of the rail so that a foot of the first part extends into a first side slot defined by a first sidewall of the rail;

positioning a second part of a rail connector in a channel of the rail so that a foot of the second part extends into a second side slot defined by a second sidewall of the rail that is opposite the first sidewall of the rail;

positioning a base element fastener adjacent to the first part and/or the second part during the positioning of the first part and the positioning of the second part so that when the first part and the second part are positioned in the channel the rail connector is placed into an assembled state that has a top hole through which the base element fastener extends.

7. The method of claim 6, comprising:

attaching a column mounting device to a first end of the rail.

8. The method of claim 7, comprising:

adjusting a height of the column mounting device.

9. The method of claim 7, wherein the column connector has a bottom part that has an opening to receive an end of a column connector that extends from a first end of the rail.

10. The method of claim 9, comprising:

positioning the column connector to attach the column connector to the rail.

11. The method of claim 7, wherein the column mounting device is comprised of a plurality of interlockable parts, each of the interlockable parts being moveable to lock the interlockable part to another one of the interlockable parts immediately adjacent to the interlockable part for direct attachment.

12. The method of claim 6, comprising:

inserting the base element fastener into a hole of a panel or a hole of a base element for attachment of the panel or the base element to the rail.

13. The method of claim 12, comprising:

positioning a covering element along a gap defined between a bottom of the panel or a bottom of the base element and the rail to cover the gap.

14. An enclosure assembly apparatus comprising:

a rail for attachment to a floor;

a rail connector comprising a first part having a first foot and a second part having a second foot, the first part being separable from the second part, the rail having a channel for facilitating attachment of the rail connector to the rail, the channel sized and configured so that the first part and the second part are positionable in the channel when separated such that the first part is positionable adjacent to the second part in the channel to form an assembled body of the rail connector;

the rail having first and second sidewalls that extend from opposite sides of a bottom of the rail to define the channel, the first sidewall and the second sidewall each defining a side slot that is in communication with the channel, the side slot of the first sidewall sized to receive the first foot of the first part and the side slot of the second sidewall sized and configured to receive the foot of the second part;

the first part and the second part defining a top hole when the assembled body of the rail connector is formed, a base element fastener being extendable vertically through the top hole; and a rail connector fastener extending horizontally between the first part and the second part for maintaining the assembly body of the rail connector in an assembled state.

15. The enclosure assembly of claim 14, comprising:

a panel, the panel having a hole, the base element fastener extending into the hole for attachment of the panel to the rail.

16. The enclosure assembly of claim 15, comprising:

a first column mounting device having an opening, the first column mounting device positionable adjacent a first end of the rail;

a first column connector having a first end for being received within the channel adjacent the first end of the rail, the first column connector having a second end for being received within the opening of the first column mounting device to attach the first column mounting device to the rail.

17. The enclosure assembly apparatus of claim 16, wherein the first column connector is comprised of a plurality of interlockable parts to adjustably define a height of the column connector so the height of the column connector is adjustable.

18. The enclosure assembly apparatus of claim 16, comprising:

a second column mounting device having an opening, the second column mounting device positionable adjacent a second end of the rail;

a second column connector having a first end for being received within the channel adjacent the second end of the rail, the second column connector having a second end for being received within the opening of the second column mounting device to attach the second column mounting device to the rail.

19. The enclosure assembly apparatus of claim 16, comprising:

a base element connector positioned adjacent a second end of the rail; the base element connector having a projection that extends vertically from a body for positioning within a base element for attachment of the base element to the rail the base element connector also having a rail end connector positionable within the channel adjacent the second end of the rail for attachment of the base element connector to the rail.

* * * * *